US007892363B2

(12) United States Patent
Brooks

(10) Patent No.: US 7,892,363 B2
(45) Date of Patent: Feb. 22, 2011

(54) CLEANING TOOL ASSEMBLY AND METHOD FOR CLEANING A FUEL INJECTOR

(76) Inventor: Robert W. Brooks, 6697 Gran Via Dr. NE., Rockford, MI (US) 49341

( * ) Notice: Subject to any disclaimer, the term of this patent is extended or adjusted under 35 U.S.C. 154(b) by 458 days.

(21) Appl. No.: 11/865,397

(22) Filed: Oct. 1, 2007

(65) Prior Publication Data

US 2008/0172819 A1 Jul. 24, 2008

Related U.S. Application Data

(60) Provisional application No. 60/885,634, filed on Jan. 19, 2007, provisional application No. 60/901,358, filed on Feb. 15, 2007.

(51) Int. Cl.
*B08B 3/04* (2006.01)

(52) U.S. Cl. ..... 134/169 A; 123/198 A

(58) Field of Classification Search ..... 134/169 A; 123/198 A
See application file for complete search history.

(56) References Cited

U.S. PATENT DOCUMENTS 4,787,348 A * 11/1988 Taylor ..... 123/198 A

* cited by examiner

*Primary Examiner*—Michael Cleveland
*Assistant Examiner*—Samuel A Waldbaum
(74) *Attorney, Agent, or Firm*—Van Dyke, Gardner, Linn & Burkhart, LLP

(57) ABSTRACT

A method of cleaning a fuel injector of an engine includes providing a cleaning tool assembly having a chamber adapted to receive cleaner and fuel therein. The cleaning tool assembly is connected to the engine and to a transfer pump adapted to provide fuel to the engine from a fuel tank. The engine is started, and pressure is created in the chamber of the cleaning tool assembly, such that cleaner flows out of the chamber and is supplied to the engine. The cleaning tool assembly transitions from supplying cleaner or a mixture of cleaner and fuel to the engine to supplying fuel to the engine.

9 Claims, 14 Drawing Sheets

CLEANING TOOL ASSEMBLY AND METHOD FOR CLEANING A FUEL INJECTOR

CROSS REFERENCE TO RELATED APPLICATIONS

The present application claims the benefit of U.S. provisional applications, Ser. No. 60/885,634, filed Jan. 19, 2007 and Ser. No. 60/901,358, filed Feb. 15, 2007, by Brooks for CLEANING TOOL ASSEMBLY AND METHOD FOR CLEANING A FUEL INJECTOR, which are hereby incorporated herein by reference in their entireties.

FIELD OF THE INVENTION

The present invention relates generally to fuel injectors, and more specifically to a cleaning tool for fuel injectors.

BACKGROUND OF THE INVENTION

A fuel injector is an electromechanical engine component which meters, atomizes and delivers fuel into a cylinder of an engine. Typically, fuel is atomized through a plurality of small openings or a through a tiny nozzle in the bottom of the injector. The atomized fuel is injected directly into the cylinder, where it mixes with air, ignites and combusts. The injector creates as fine a mist as possible, so that the fuel can burn easily in the cylinder.

In order for the fuel injection system to perform efficiently, the openings in the fuel injector must be clean and clear. Clean fuel injectors are a must for peak engine performance, fuel economy and emissions. However, with use, injector openings may become clogged or even blocked by accumulated deposits and debris. Dirty or clogged fuel injectors cannot provide as much fuel to the cylinder as clean injectors, nor can they deliver the correct spray pattern that is essential for clean, efficient combustion. As a result, clogged fuel injectors may result in lean fuel misfire, rough idle of the engine, hesitation and stumbling upon light acceleration of the engine, a loss of power, and higher hydrocarbon and carbon monoxide emissions. Thus, dirty or clogged fuel injectors have an adverse effect on performance, fuel economy and emissions.

Because of their small size, keeping fuel injector openings clean and clear is often difficult. Presently, technicians may use a relatively complicated electric pump to clean fuel injectors. The pump includes a large cabinet having two separate tanks of cleaning fluid and fuel, respectively. While the engine is running, cleaning fluid is pumped through the fuel injection system. When the cleaning fluid tank is empty, the machine begins pumping fuel from the fuel tank of the machine through the fuel injection system. However, this type of pump is cumbersome and expensive, and requires electrical components to provide the pumping function.

Another option is to add a special cleaner to the fuel. While these types of cleaners may be help to maintain clean fuel injectors, they will not cure a fuel injection problem or clear a blocked injector opening.

SUMMARY OF THE INVENTION

According to an aspect of the present invention, a method of cleaning a fuel injector of an engine is provided, the engine having a fuel injection system including a fuel tank and a transfer pump adapted to supply fuel from the fuel tank to the engine. The method includes providing a cleaning tool assembly having a chamber adapted to receive cleaner and fuel therein and connecting the cleaning tool to the engine and the transfer pump. The engine is started, and cleaner and/or fuel is supplied to the chamber of the cleaning tool assembly, which creates pressure in the chamber and causes or forces either cleaner or a mixture of cleaner and fuel to flow out of the chamber. The cleaner or mixture of cleaner and fuel is supplied or transferred from the chamber to the engine. The cleaning tool assembly transitions from supplying either cleaner or a mixture of cleaner and fuel to the engine to supplying fuel to the engine.

The method may include separating the chamber into a fuel portion adapted to receive fuel and a cleaner portion adapted to receive cleaner. For example, the chamber may be separated or divided with a piston, which may move in response to pressure in the fuel portion of the chamber to expand the fuel portion and contract the cleaner portion. To create pressure in the fuel portion, fuel from the fuel tank may be supplied to the fuel portion through or via a fuel line inlet adapted to transfer fuel from the fuel tank. The method may also include regulating the pressure in the fuel portion.

In response to the pressure in the fuel portion, the piston may move along a conduit that is in fluid communication with either the cleaner portion or the fuel portion, depending on the position of the piston in the chamber. For example, the cleaning tool assembly may be adapted to supply cleaner to the engine when the conduit is in fluid communication with the cleaner portion and to supply fuel to the engine when the conduit is in fluid communication with the fuel portion. Thus, the movement of the piston may cause or result in the cleaning tool assembly transitioning from supplying cleaner to the engine to supplying fuel to the engine. After the transition to supplying fuel, the cleaning tool assembly may be removed from the fuel injection system or may be permanently connected to the system.

According to another embodiment the transition to supplying fuel to the engine includes diluting the cleaner with fuel. In such an embodiment, pressure in the chamber forces the cleaner and/or fuel contained in the chamber out of the chamber and into a fuel line inlet adapted to supply fuel from the fuel tank to the engine. The cleaning tool assembly may be connected to the engine such that cleaner and/or fuel from the engine is supplied back to the chamber via a fuel line outlet.

According to another aspect of the invention, a cleaning tool assembly includes a housing defining a chamber or interior volume that is adapted to receive cleaner and fuel therein and a conduit in fluid communication with the chamber. The conduit is adapted to be in fluid communication with a fuel line connected to the engine. Pressure in the chamber forces cleaner and/or fuel contained in the chamber into and through the conduit, such that the conduit is adapted to supply the cleaner and/or fuel to the engine via the fuel line.

Optionally, the cleaning tool assembly includes a piston positioned in the chamber for dividing the chamber into a cleaner portion adapted to receive cleaner and a fuel portion adapted to receive fuel. The conduit is operatively engaged with the piston, which includes an aperture through which the conduit may be positioned, such that the piston may travel along the conduit. The conduit includes an opening in fluid communication with either the cleaner portion or the fuel portion, as a function of a position of the piston. The engine fuel supplied by the transfer pump creates pressure in the fuel portion that causes the piston to travel along the conduit to an opposite side of the opening in the conduit. The movement of the piston transitions the opening from receiving cleaner from the cleaner portion to receiving engine fuel from the fuel portion. The conduit is adapted to be connected to a fuel line that is connected to the engine. Thus, the conduit supplies the cleaner or fuel from the cleaning tool assembly to the engine. Optionally, fuel is supplied to the engine immediately after the cleaner runs out, to prevent air from entering the fuel line to the engine.

A valve may be provided for regulating pressure in the fuel chamber of the housing. Further, a gauge may be provided for displaying the pressure in the fuel chamber. The pressure in the fuel chamber may be adjusted for the piston to travel from a starting position to an ending position in the housing in between 10 and 20 minutes. An indicator may also be included to indicate that the piston has finished traveling inside the chamber. Optionally, the cleaning tool assembly may be adapted to be permanently connected to the fuel injection system of the engine. The cleaning tool assembly may be used to clean the fuel injectors of either a diesel engine or a gasoline engine.

According to another embodiment of the invention, a cleaning tool assembly for cleaning a fuel injector of an engine includes a housing defining a chamber adapted to receive cleaner and fuel therein. The tool assembly includes a conduit in fluid communication with the chamber and a fuel line inlet adapted to supply fuel from the fuel tank to the engine. The tool assembly also includes a valve in fluid communication with the chamber and a fuel line outlet adapted to supply fuel from the engine to the chamber. The engine supplies fuel to the chamber via the valve, which creates pressure in the chamber and forces the cleaner and fuel contained in the chamber into and through the conduit. The conduit is adapted to supply the cleaner and fuel from the chamber to the fuel inlet and to the engine.

Thus, a cleaning tool assembly and method are provided for cleaning the fuel injectors of an engine, such as a diesel or gasoline engine of an automobile, truck or boat. The cleaning tool assembly is adapted to use the transfer pump of an engine as an energy source, as opposed to requiring a separate power source or pump. Therefore, the cleaning tool assembly is able to operate mechanically, and does not require electric components or assemblies, resulting in a light weight and relatively inexpensive device, as opposed to the electric pumps currently used. In addition, the cleaning tool assembly uses fuel from the vehicle's own tank in the cleaning process, as opposed to requiring a separate fuel tank, which further reduces the size and weight of the device.

These and other objects, advantages, purposes and features of the present invention will become apparent upon review of the following specification in conjunction with the drawings.

DESCRIPTION OF THE PREFERRED EMBODIMENTS

Figure 1:
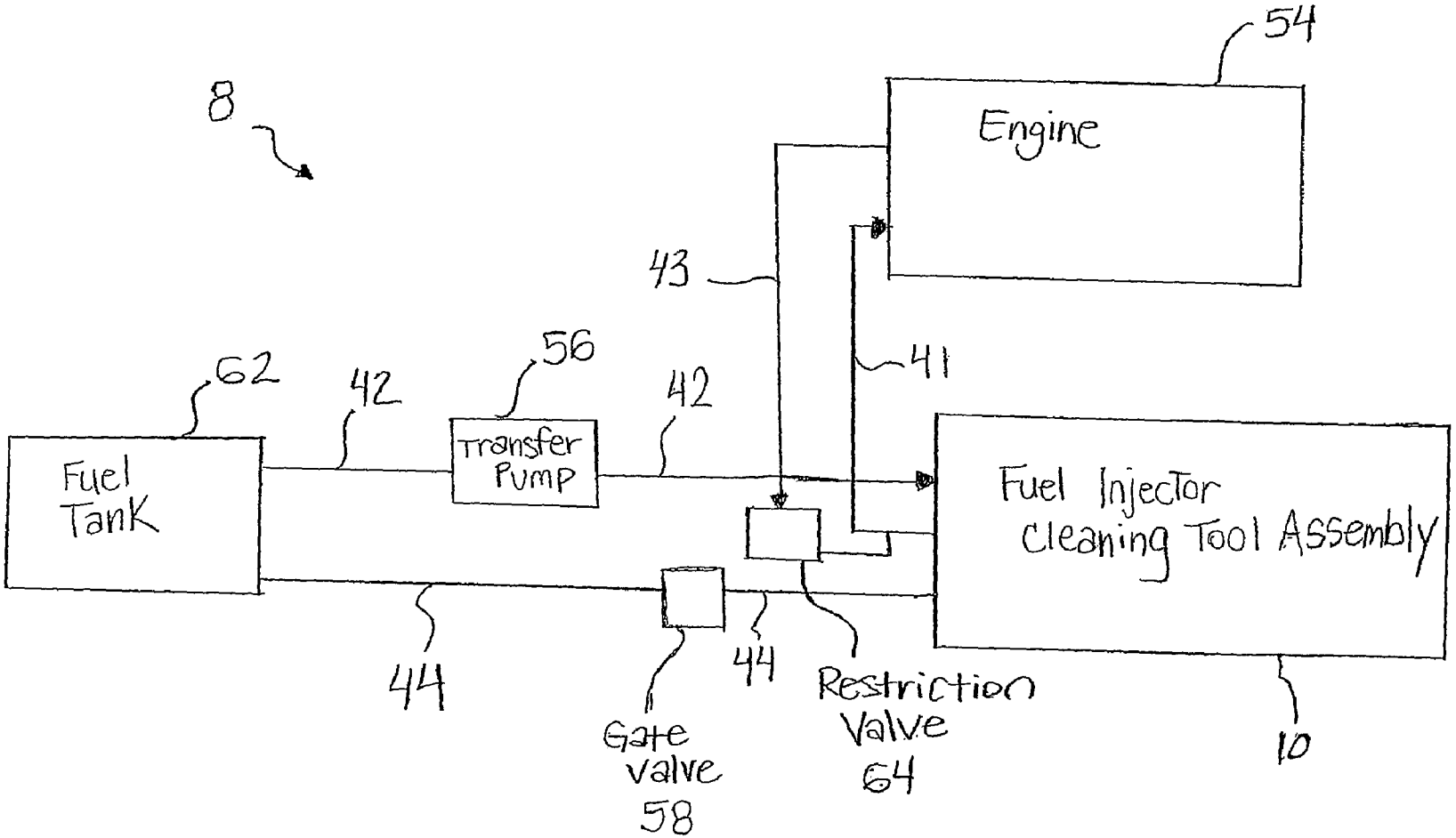
FIG. 1 is a flow chart of a cleaning system according to an aspect of the present invention.
Figure 15:
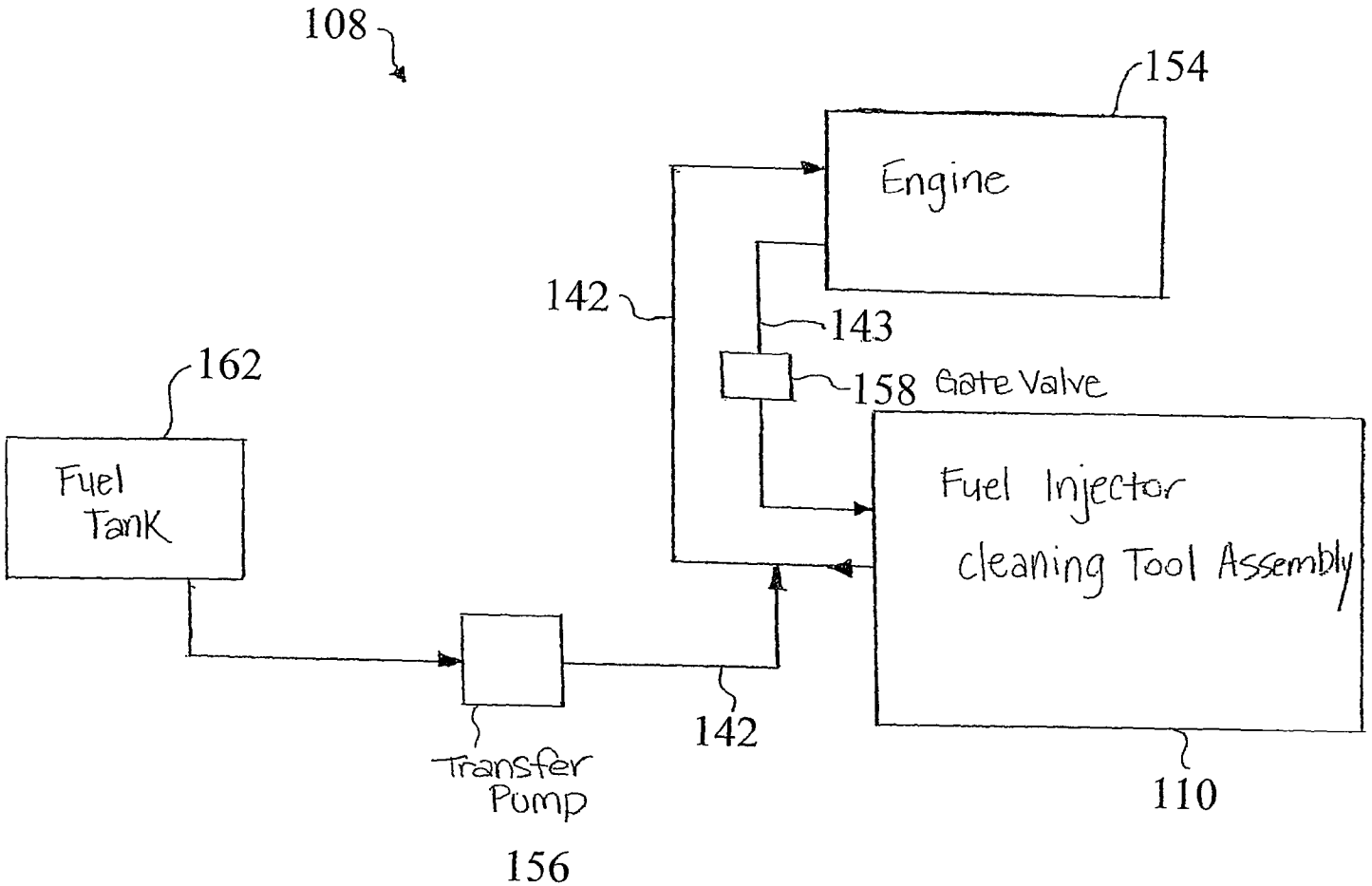
FIG. 15 is a flow chart of another cleaning system according to an aspect of the present invention.

Referring now to the drawings and the embodiments illustrated therein, a method of cleaning a fuel injector is provided for cleaning deposits and debris from the apertures in the fuel injectors of an engine 54, 154 (FIGS. 1 and 15). Engine 54, 154 has a fuel injection system, including a fuel tank 62, 162 and a transfer pump 56, 156 adapted to pump fuel from fuel tank 62, 162 to engine 54, 154. The method includes providing a cleaning tool assembly 10, 110 which includes a housing that defines a chamber adapted to receive cleaner and fuel therein. Cleaning tool assembly 10, 110 is connected to engine 54, 154 and transfer pump 56, 156 and is adapted to provide cleaner to the fuel injectors of the engine. When engine 54, 154 is started, power is supplied to transfer pump 56, 156, and cleaner and/or fuel from is supplied to the chamber of the cleaning tool assembly to create pressure in the chamber. In response to the pressure in the chamber, either cleaner or a mixture of cleaner and fuel flows out of the chamber and is supplied to engine 54, 154. The method further includes transitioning from supplying either cleaner or a mixture of cleaner and fuel to the engine to supplying fuel to the engine.

Figure 2:
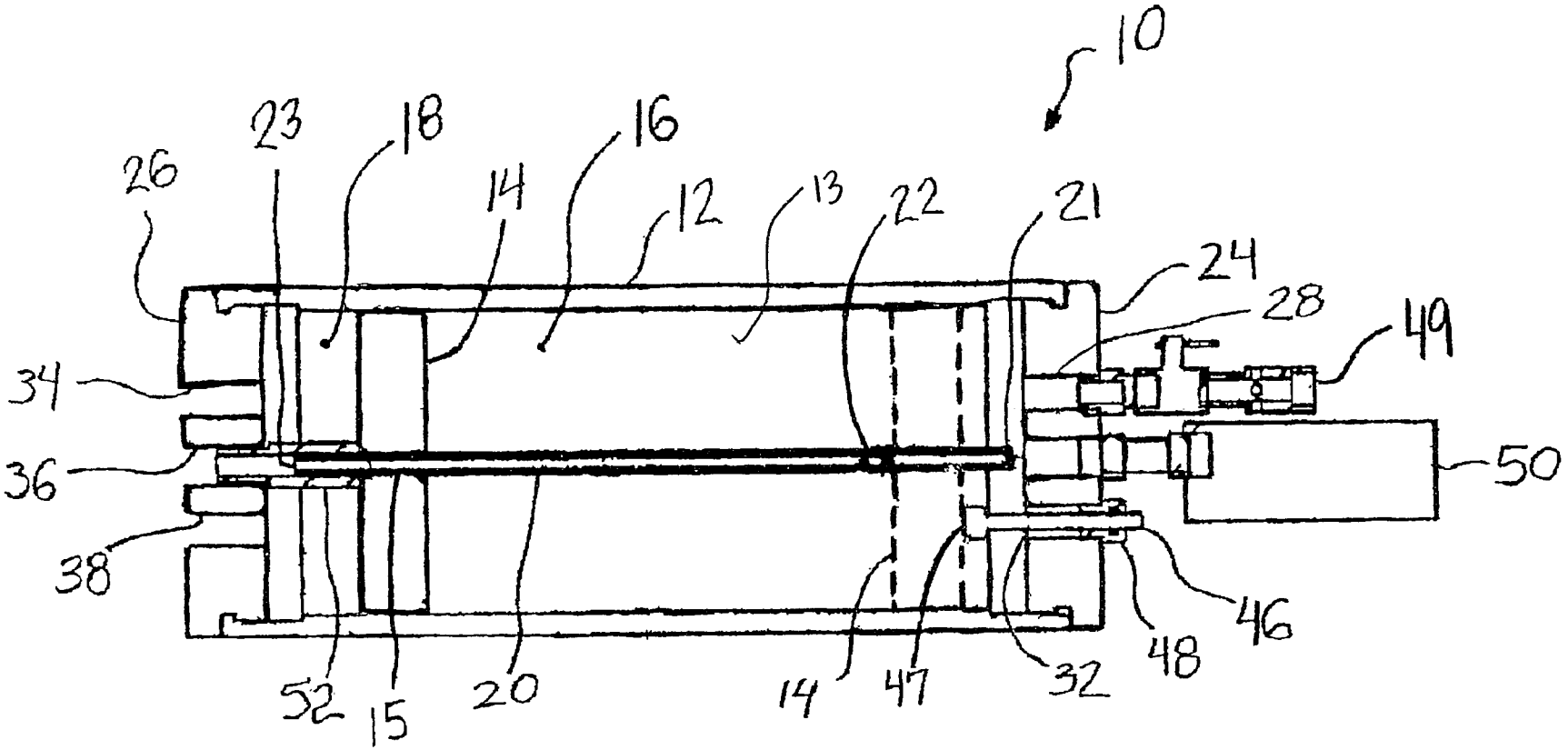
FIG. 2 is a top plan view of a cleaning tool assembly according to an aspect of the present invention.
Figure 4:
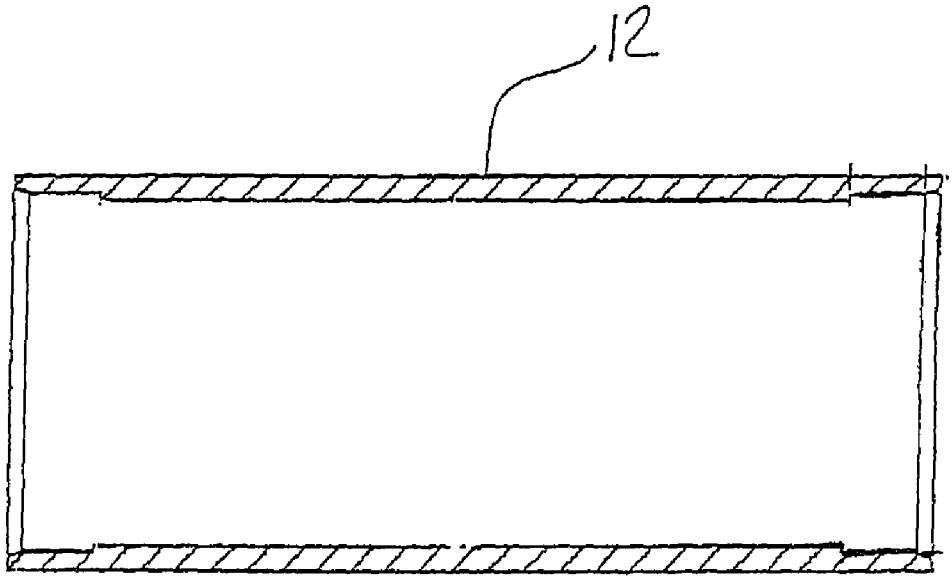
FIG. 4 is a top plan view of a housing of the cleaning tool assembly of FIG. 1.

According to the illustrated embodiment of FIG. 1, cleaning tool assembly 10 includes a housing 12 that defines a chamber 15, which is divided or separated into a cleaner section or portion 16 adapted to receive cleaner and a fuel section or portion 18 adapted to receive fuel (FIGS. 2 and 4). Prior to beginning the cleaning cycle, cleaner portion 16 is filled with cleaner. Fuel from fuel tank 62 is supplied to fuel portion 18, such as via a fuel line inlet 42, which creates pressure in fuel portion 18 of cleaning tool assembly 10.

Figure 5:
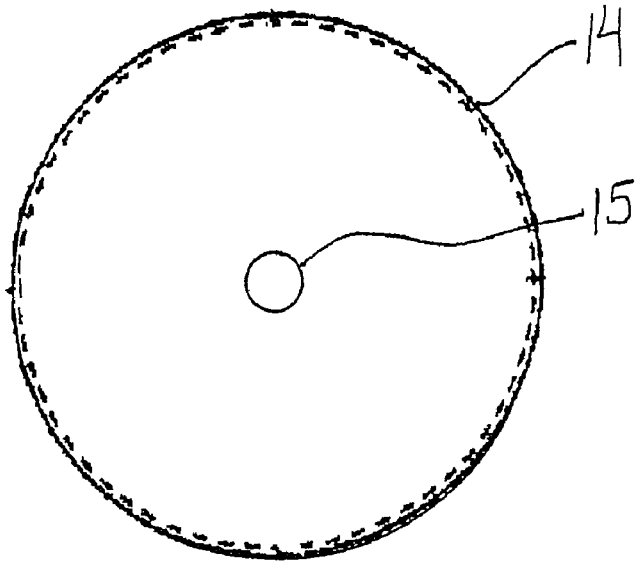
FIG. 5 is an end view of a piston of the cleaning tool assembly of FIG. 1.
Figure 6:
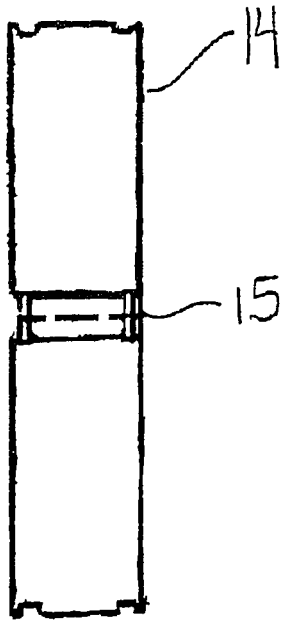
FIG. 6 is a side elevation of the piston of FIG. 7.

Optionally, chamber 13 is divided into cleaner portion 16 and fuel portions 18 by a piston 14 that is movable or slidable within chamber 13 (FIGS. 5 and 6). The pressure created in fuel portion 18 of chamber 13 causes piston 14 to move or travel in chamber 13 toward cleaner portion 16, to expand fuel portion 18 and contract cleaner portion 16. The contraction of cleaner portion 16 forces the cleaner contained therein to exit cleaner portion 16. Thus, as fuel enters fuel chamber 18, cleaner exits cleaner chamber 16. The cleaner that exits cleaner portion 16 is supplied to engine 54, such as via a fuel line 41 (FIG. 1). Therefore, in the illustrated embodiment, the fuel that would traditionally be supplied to engine 54 is supplied to cleaning tool assembly 10, and cleaner contained in cleaning tool assembly 10 is supplied to engine 54 instead of fuel.

Figure 7:
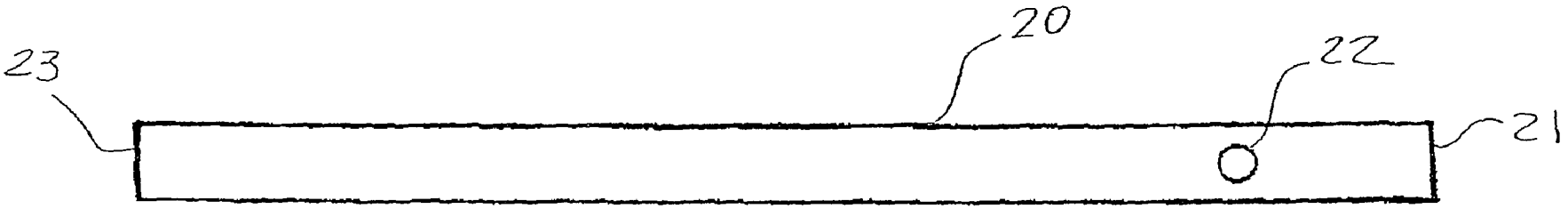
FIG. 7 is a side elevation of a conduit of the cleaning tool assembly of FIG. 1.

Piston 14 is adapted travel or slide along a tube or conduit 20 in chamber 13 (FIGS. 2 and 7). In the illustrated embodiment, conduit 20 includes an opening or valve 22, such that conduit 20 is in fluid communication with cleaner portion 16. When cleaner portion 16 contracts, cleaner exits the cleaner portion through opening 22 and enters conduit 20, which is adapted to be connected to fuel line 41. Thus, cleaner is supplied to engine 54 via conduit 20.

The method may include regulating the pressure in fuel portion 18. In the illustrated embodiment, a valve or gate valve 58 is provided. By regulating the pressure in the fuel chamber, the operator is able to control the speed at which cleaner exits cleaner portion 16 and the total amount of time that cleaner is supplied to engine 54.

The method also includes transitioning from supplying cleaner to supplying fuel to engine 54. For example, as piston 14 moves or travels along conduit 20 in chamber 13, piston 14 travels to an opposite side of valve 22 in conduit 20, such that valve 22 becomes positioned in fluid communication with fuel portion 18 as opposed to cleaner portion 16. The movement of piston 14 across valve 22 results in an immediate transition from supplying cleaner to supplying fuel to engine 54, which prevents the introduction of significant amounts of air into the fuel system.

After the transition from supplying cleaner to supplying fuel to engine 54, the fuel injector cleaning cycle is complete, and cleaning tool assembly 10 may be removed and/or disconnected from engine 54, fuel tank 62 and transfer pump 56. However, if required or desired, cleaning tool assembly 10 may be removed at any time during the cleaning process, or may be adapted to remain permanently connected to the fuel injection system so that the tool assembly is readily available for future cleaning.

Figure 16:
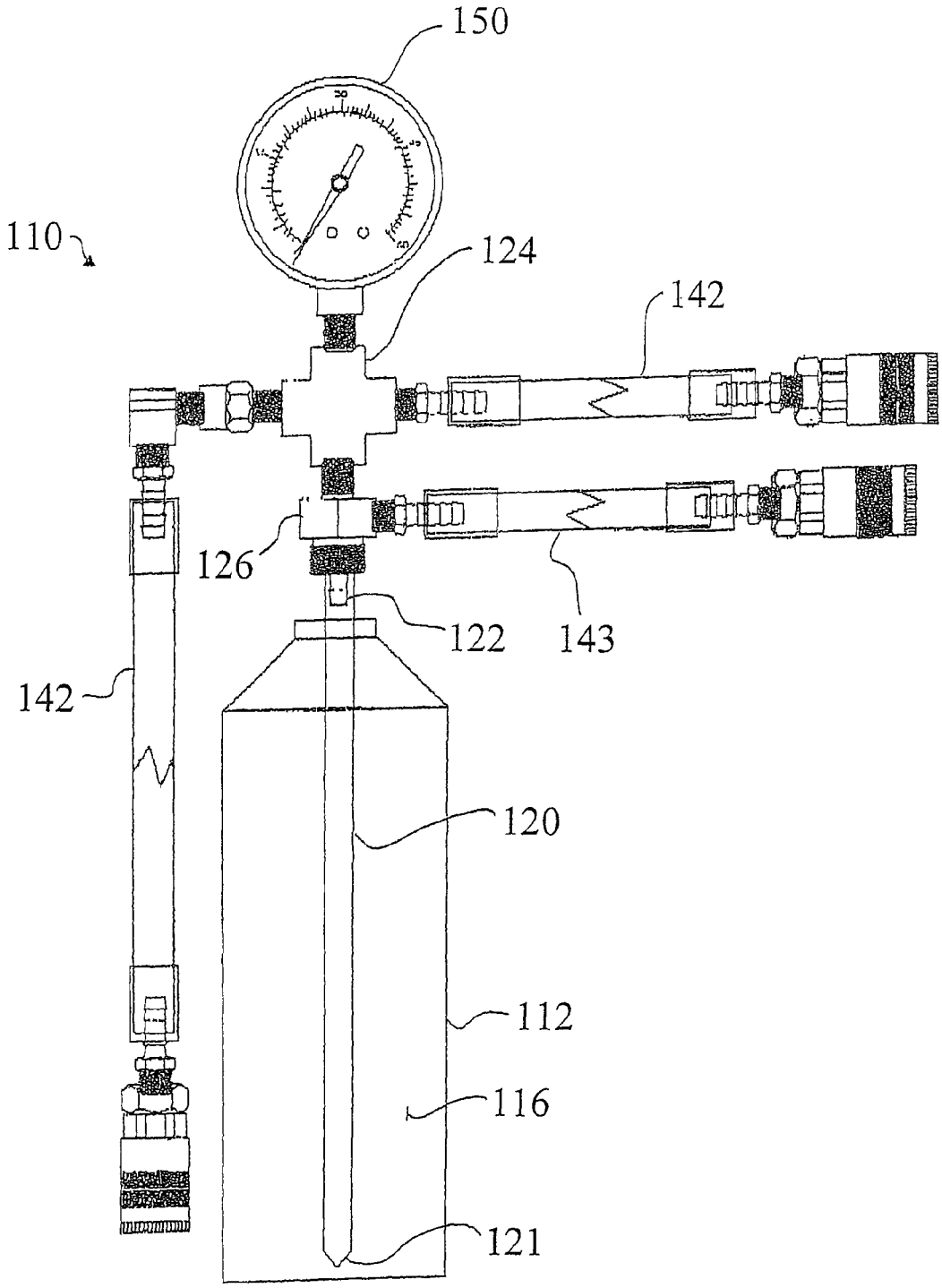
FIG. 16 is a front elevation of another cleaning tool assembly according to an aspect of the present invention.

In an alternative embodiment, a cleaning tool assembly 110 includes a canister or housing 112, which defines a chamber 116 adapted to receive cleaner and fuel therein (FIGS. 15 and 16). Prior to beginning the cleaning cycle, chamber 116 is filled with cleaner. Housing 112 is adapted to be connected between transfer pump 156 and engine 154 via a fuel line inlet 142, and is also connected to engine 154 via a fuel line outlet or fuel return line 143.

The method includes starting engine 154 to supply power to transfer pump 156, which is adapted to supply fuel from fuel tank 162 to engine 154 via fuel line inlet 142. Before the fuel reaches the engine, cleaner from cleaning tool assembly 110 is injected or introduced into fuel line inlet 142, such as via a tube or conduit 120, and is added to or mixed with the fuel from fuel tank 162 (FIG. 16). The mixture of fuel and cleaner is supplied to engine 154 and cycles through engine 154, and is returned into chamber 116 of housing 112 via fuel line outlet or fuel return line 143.

The addition of the fuel and cleaner mixture into chamber 116 creates pressure in chamber 116, thus forcing the contents of chamber 116 into and through conduit 120, out of chamber 116 of housing 112 and into fuel line inlet 142, which directs the fuel and cleaner mixture into fuel line inlet 142 and to engine 154. Thus, the cleaner is confined to a continuous loop between housing 112 and engine 154.

The method further includes transitioning from supplying either cleaner or a mixture of cleaner and fuel to engine 154 to supplying only fuel to the engine 154. The transition is a result of the fuel from fuel tank 162 gradually diluting the cleaner and fuel mixture until the cleaner is completely diluted in the fuel, such that only fuel is being circulated through cleaning tool assembly 110 and engine 154. Once the cleaner is completely diluted, engine 154 may continue to run on fuel while cleaning tool assembly 110 remains connected to the engine. Thus, an operator is not required to remove the tool at a specified time. Further, because the cleaner gradually becomes diluted with fuel, there is no definitive transfer from cleaner to fuel. Thus, the cleaning tool assembly may be removed without introducing significant amounts of air into the fuel system.

According to another embodiment, a cleaning tool assembly 10, 110 for cleaning the fuel injectors of an engine includes a housing 12, 112 that defines a chamber adapted to receive cleaner and fuel therein. A conduit 20, 120 is in fluid communication with the chamber and is adapted to be in fluid communication with a fuel line connected to the engine. Pressure in the chamber of cleaning tool assembly 10, 110 forces cleaner and/or fuel contained in the chamber into and through conduit 20, 120, which is adapted to supply the cleaner and/or fuel to the engine via the fuel line connecting conduit 20, 120 and the engine.

With respect to the structure of cleaning tool assembly 10, conduit 20 may be formed as a tube or pipe through which cleaner or fuel may flow. Valve 22 of conduit 20 is positioned at or near an end of cleaner portion 16 opposite piston 14 (FIG. 2). Thus, valve 22 is initially in fluid communication with cleaner portion 16 of housing 12 and continues to be in fluid communication therewith until piston 14 travels to the opposite end of chamber 13, to an opposite side of valve 22, which will be discussed in more detail below. Optionally, conduit 20 includes an open end 21 through which cleaner or fuel may flow into conduit 20 (FIGS. 2 and 7). Open end 21 may be included on conduit 20 in addition to valve 22, or as an alternative element through which cleaner may flow into conduit 20.

To facilitate movement of piston 14 along conduit 20, piston 14 may include an opening or aperture 15, through which conduit 20 may be inserted or positioned (FIGS. 5 and 6). In this configuration, piston 14 may slide or otherwise travel along conduit 20. The movement of piston 14 along conduit 20 facilitates the flow of cleaner contained in cleaner portion 16 through valve 22. For example, in response to pressure in fuel chamber 18, piston 14 travels in housing 12 toward cleaner portion 16, which expands fuel portion 18 and therefore contracts cleaner portion 16. As cleaner portion 16 contracts, cleaner is forced to flow through valve 22 and into conduit 20, where it is directed to engine 54 via fuel line 41.

To create the required pressure in fuel portion 18 to cause piston 14 to move, cleaning tool assembly 10 is adapted to use a standard transfer pump as a power source. For example, in the illustrated embodiment, the system is connected to transfer pump 56, which is included as part of the fuel injection system of engine 54. When engine 54 is started, power is supplied to transfer pump 56, which begins pumping fuel into fuel portion 18. Thus, cleaning tool assembly 10 is adapted to be powered mechanically by transfer pump 56, such that no additional power source or other electrical components are required. As a result, cleaning tool assembly 10 is considerably lower in cost and smaller in size and weight than previously used fuel injector cleaning devices.

Further, cleaning tool assembly 10 is adapted to receive fuel from the fuel supply of the engine to which it is connected, such as the fuel tank of a vehicle. For example, transfer pump 56 supplies fuel to cleaning tool assembly 10 from fuel tank 62, which is provided in the engine system. As a result, cleaning tool assembly 10 does not require an additional or external fuel supply or tank which allows cleaning tool assembly 10 to be significantly smaller in size, weight and bulk than fuel injector cleaning apparatuses previously used.

At some point during the movement of piston 14 along conduit 20, piston 14 passes over valve 22 and becomes positioned at an opposite side of housing 12 with respect to valve 22. In this position, piston 14 expands fuel portion 18 to include the portion of conduit 20 having valve 22, such that valve 22 has become positioned in fluid communication with fuel portion 18, which contains fuel supplied by transfer pump 56. Thus, as piston 14 passes over valve 22, there is a transition from supplying cleaner to supplying fuel to valve 22 and conduit 20. Optionally, the transition from cleaner to fuel may occur immediately to prevent air from entering fuel line 41, which prevents a lean mixture of air and fuel in the engine cylinder.

Figure 12:
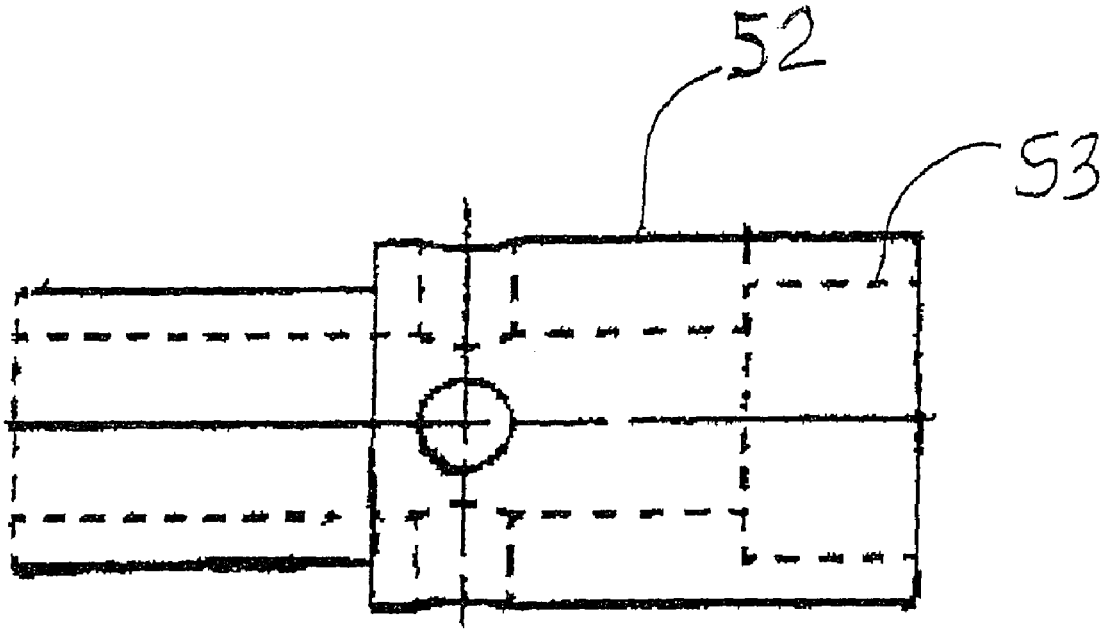
FIG. 12 is a side elevation of a fitting of the cleaning tool assembly of FIG. 1.
Figure 13:
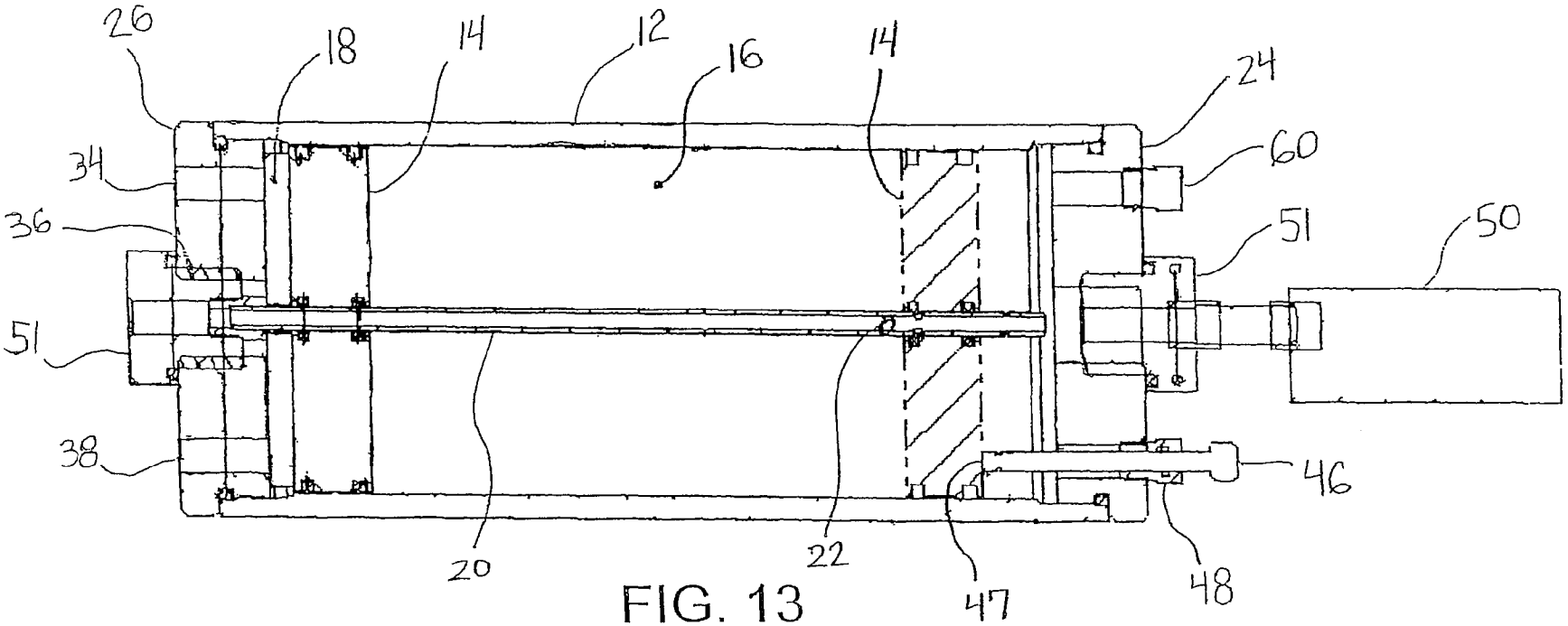
FIG. 13 is a top plan view of a cleaning tool assembly according to another aspect of the invention.
Figure 14:
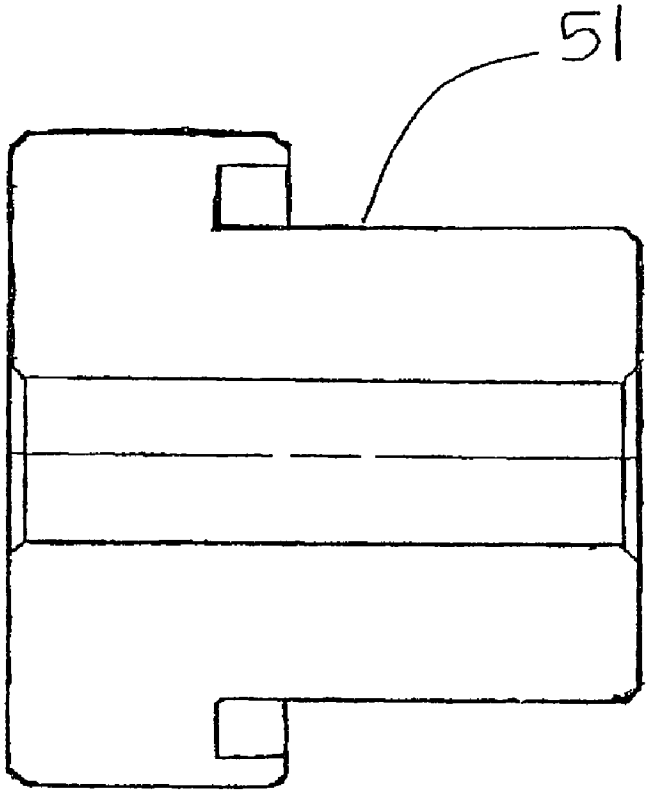
FIG. 14 is a top plan view of a threaded plug of the cleaning tool assembly of FIG. 13.

To facilitate the connection of cleaning tool assembly 10 to engine 54, conduit 20 may include an end 23 adapted to be connected to fuel line inlet 41, such as through opening 36 of housing 12 (FIG. 2). Accordingly, cleaner flowing into conduit 20 may be supplied through fuel line 41 to the fuel injectors of engine 54. Optionally, a fitting 52 or threaded plug 51 may be provided to facilitate the connection of conduit 20 to fuel line 41. For example, in the illustrated embodiment, fitting 52 is adapted to be inserted into opening 36 from inside housing 12 and includes an opening 53 adapted to receive end 23 of conduit 20 (FIGS. 2 and 12). Fuel line 41 may be inserted into opening 36 from outside of housing 12, such that cleaner may flow from conduit 20 into fuel line 41. Threaded plug 51 may facilitate a similar connection of conduit 20 to fuel line inlet 42, although plug 51 may be threadably connected to housing 12 at opening 36 (FIGS. 13 and 14).

Housing 12 and piston 14 may be generally cylindrical, such that piston 14 is adapted to fit and travel within housing 12. Further, a seal may be formed between an outer edge of piston 14 and an inner surface of housing 12. Optionally, piston 14 may include an Aluminum/Viton® seal, to engage the inner surface of housing 12. Also, in an embodiment in which conduit 20 is positioned through aperture 15 in piston 14, conduit 20 may be form-fitted or sealed at aperture 15 such that piston 14 may slide along conduit 20 without breaking the seal between conduit 20 and piston 14.

Figure 3:
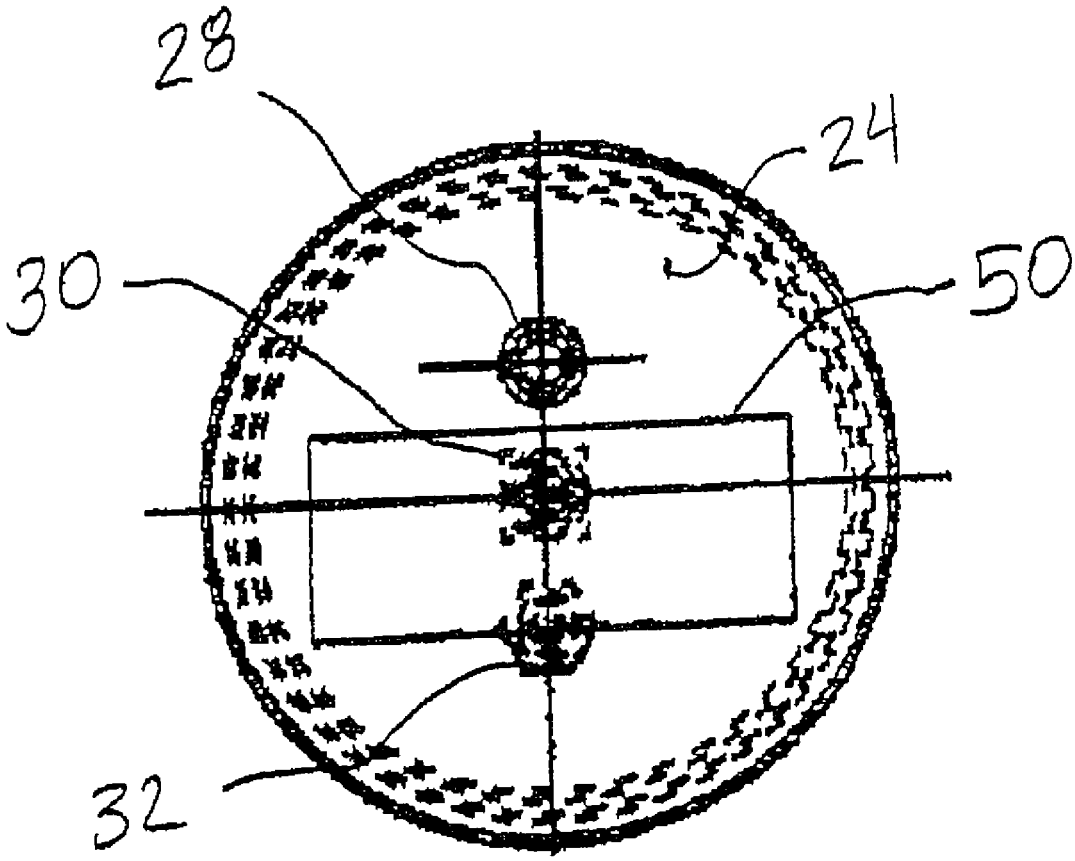
FIG. 3 is a side elevation of the cleaning tool assembly of FIG. 1.

To regulate the pressure in fuel portion 18, a valve 58, such as a gate valve, may be included, as discussed above. A monitor and/or gauge 50 may be provided to display the pressure determined by gate valve 58 (FIGS. 2 and 3). The pressure in fuel chamber 18 may be adjusted such that piston 14 will take approximately 10 to 20 minutes to travel from a starting position to an ending position in housing 12. Optionally, the pressure may be adjusted to between 5 and 25 psi. However, cleaning tool assembly 10 is adapted to withstand much higher pressures. Because use of the cleaning tool assembly may cause a drop in pressure in the fuel return line, a valve 64, such as a restrictor or restriction valve, may be included to create a pressure differential between the fuel line outlet 43 and fuel line 41 or 42. Restriction valve 64 maintains a level of pressure in the fuel return line such that a vehicle's low pressure signal or warning, such as a buzzer or light or the like, will not be set off or triggered during operation of cleaning tool assembly 10.

Figure 8:
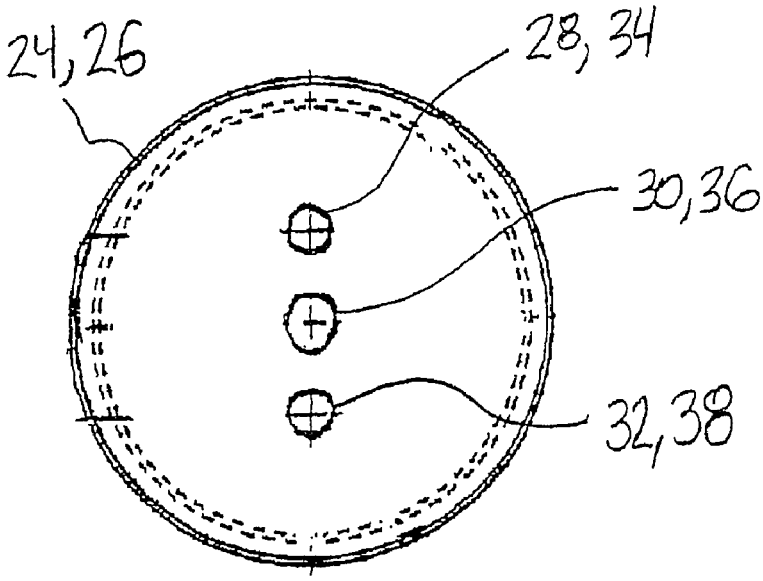
FIG. 8 is an end view of an end cap of the housing of FIG. 4.
Figure 9:
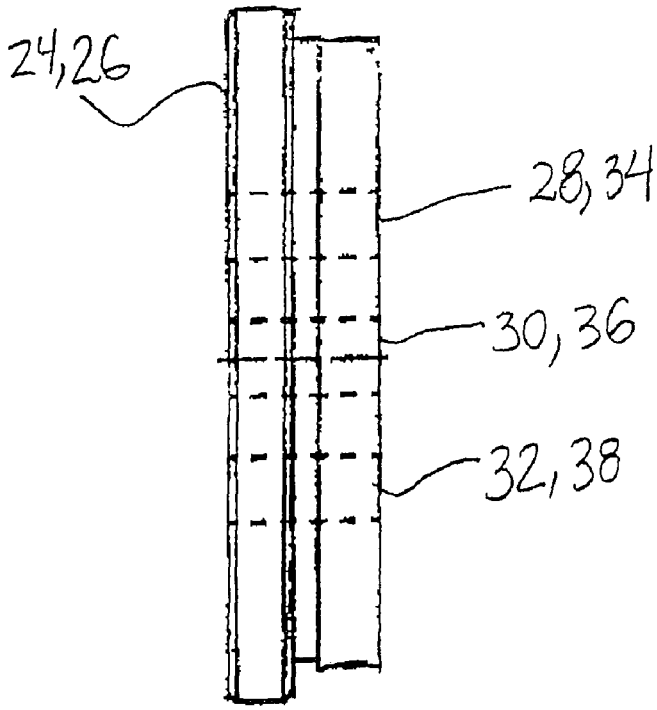
FIG. 9 is a side elevation of the end cap of FIG. 5.

Housing 12 may include end caps 24, 26, which may be identical and may each include three openings therethrough (FIGS. 2, 8 and 9). End cap 26 may include openings 34, 36, 38 to facilitate the functional connection of cleaning tool assembly 10 to engine 54, fuel tank 162 and transfer pump 156. End cap 24 may likewise include functional openings 28, 30, 32. For example, gauge 50 may be form-fitted or threadably connected, such as by a threaded plug 51, to cleaning tool assembly 10 at opening 30. Optionally, gauge 50 may be removed from opening 30 such that cleaner may be poured or otherwise injected into cleaner chamber 16 through opening 30.

Figure 10:
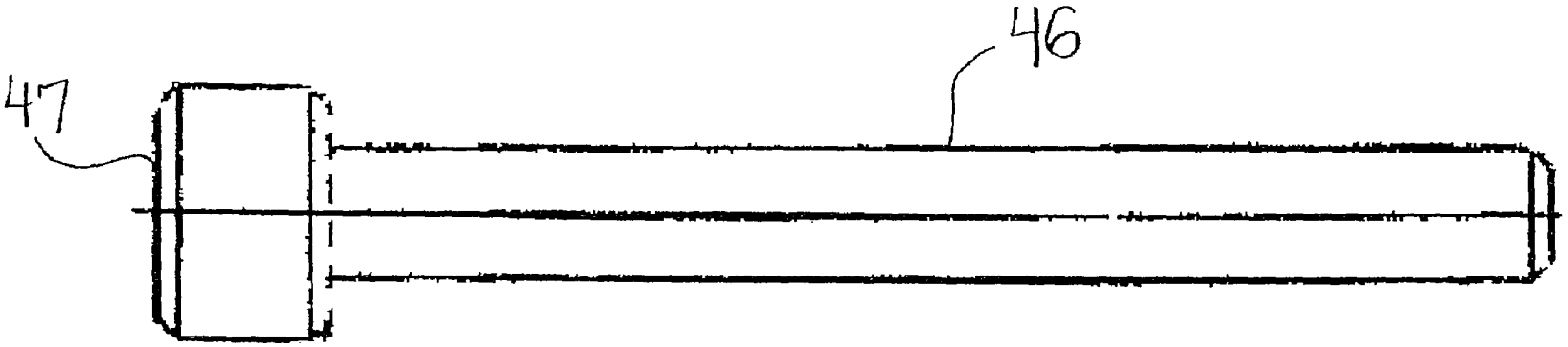
FIG. 10 is a side elevation of an indicator of the cleaning tool assembly of FIG. 1.
Figure 11:
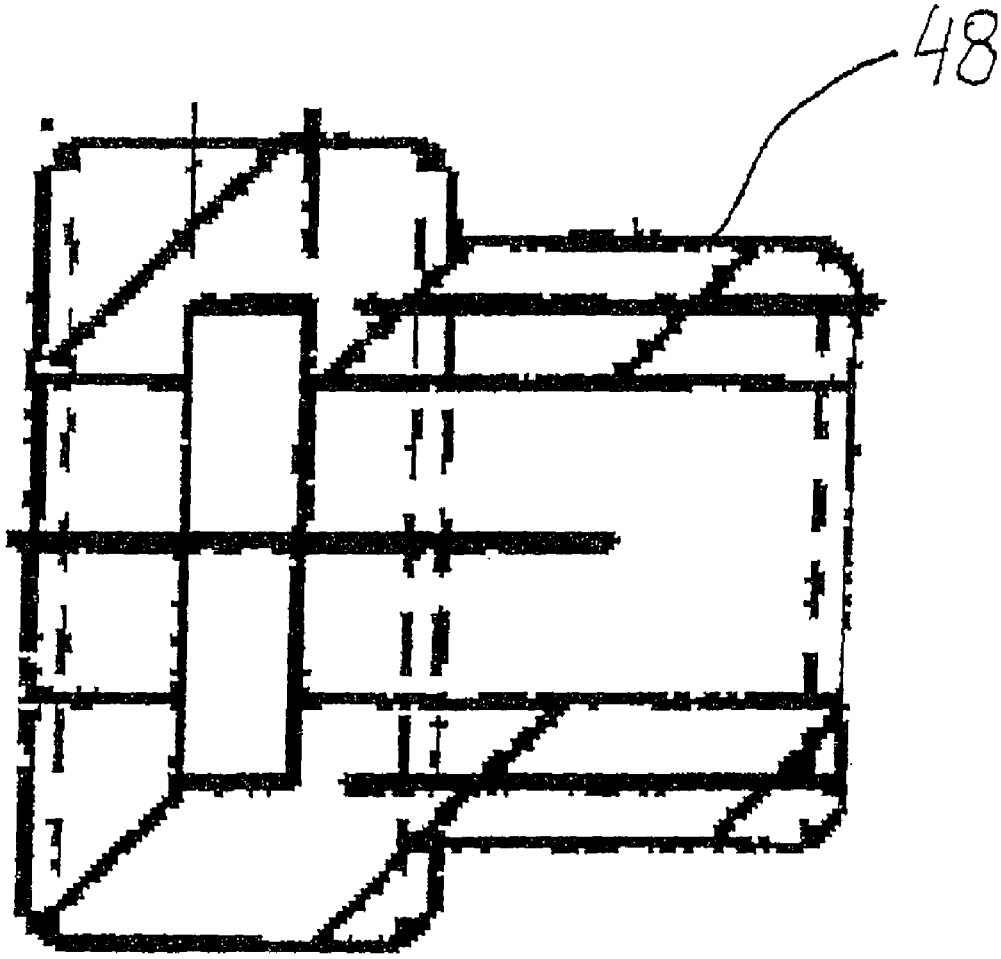
FIG. 11 is a side elevation of an indicator nut of the cleaning tool assembly of FIG. 1.

Further, opening 32 of end cap 24 may accommodate an indicator 46, which functions to indicate to an observer or technician that the fuel injector cleaning cycle is complete. Indicator 46 may be positioned through cleaner chamber end cap 24 and partially within cleaner chamber 16 of housing 12 (FIGS. 2 and 10). To prevent indicator 46 from sliding out of end cap 24, indicator 46 may include flanged ends. Piston 14 may engage an end 47 of indicator 46 until indicator 46 at least partially protrudes from end cap 24, thus providing indication that the fuel injector cleaning cycle is complete. Optionally, an indicator nut 48 may be provided to retain and guide the movement of indicator 46 (FIG. 11).

Once piston 14 has reached its ending position near end cap 24, such that cleaning tool assembly 10 is supplying fuel, as opposed to cleaner, to the engine, cleaning tool assembly 10 may be removed or disconnected from the fuel injection system, for example, from engine 54, transfer pump 56 and fuel tank 62. Optionally, cleaning tool assembly 10 may be adapted to be permanently connected to at least part of the fuel injection system, or permanently connected at another position on the vehicle or boat or the like, and refilled with cleaner as desired, such that cleaning tool assembly 10 is readily available for further cleaning cycles.

To return piston 14 from its ending position near end cap 24 to its starting position near end cap 26, pressure may be created in cleaner portion 16 of housing 12. For example, compressed air may be injected into cleaner chamber 16 through a valve 49, such as a pneumatic valve or the like, which may be connected to housing 12 at opening 28 (FIG. 2). The pressure from the compressed air causes pressure to build in cleaner portion 16 and on piston 14, thus causing piston 14 to travel in housing 12 toward fuel chamber 18. Piston 14 eventually reaches its starting position, in which cleaner portion 16 is expanded and able to receive cleaner for another fuel injector cleaning cycle.

Alternately, piston 14 may be manually returned to its starting position in housing 12, without the use of pneumatic valve 49 or the like. For example, conduit 20 may be adapted to be pulled through opening 36 and at least partially out of housing 12. Further, conduit 20 may engage, or otherwise be connected to, piston 14, such that movement of conduit 20 through opening 36 pulls piston 14 in housing 12 toward fuel portion 18 and end cap 26, and eventually to the starting position of piston 14, in which cleaner portion 16 is expanded and adapted to again be filled with cleaner. In this embodiment, because valve 49 is not required, a plug 60 may be provided to block opening 28.

Optionally, fitting 52 or threaded plug 51 may be used to facilitate the movement of conduit 20 through opening 36 (FIGS. 12-14). As discussed above, fitting 52 or threaded plug 51 may be used to connect conduit 20 to fuel line inlet 142 at opening 36. Conduit 20 may be connected, soldered or otherwise attached to fitting 52 or threaded plug 51, such that movement of fitting 52 or plug 51 away from housing 12 pulls conduit 20 and piston 14 toward fuel chamber 18.

According to another embodiment, cleaning tool assembly 110 includes a housing or housing 112 that is formed as a closed body shape and that defines a chamber 116 adapted to contain a fluid such as cleaner and/or fuel (FIG. 16). In the illustrated embodiment, housing 112 is generally cylindrical and includes an opening at an end portion thereof adapted to receive a conduit or tube 120. Prior to use of cleaning tool assembly 110, chamber 116 is adapted to be filled with cleaner.

Conduit 120 is adapted to provide fluid communication between chamber 116 of housing 112 and fuel line inlet 142, through which fuel is supplied from fuel tank 162 to engine 154. In the illustrated embodiment, conduit 120 is formed as a hollow tube or pipe and is connected at one end to fuel line inlet 142, such as by a connector 124 (FIG. 16). Conduit 120 extends into chamber 116 and may be adapted to be connected at an opening in housing 112, such as by a fitting or threaded plug or the like, such that conduit 120 may be form fitted or threadably connected to housing 112. Conduit 120 includes an opening, such as open end 121, which is in fluid communication with chamber 116 of housing 112, such that conduit 120 is adapted to receive the cleaner or fuel or mixture thereof contained in chamber 116 through open end 221. The cleaner or fuel or mixture thereof is adapted to flow through conduit 120 into fuel line inlet 142, where it is directed to engine 154, specifically, to the fuel injectors of engine 154.

Cleaning tool assembly 110 may include a valve 122, which may be formed as a tube or hose or the like, to provide fluid communication between housing 112 and fuel line outlet 143. In the illustrated embodiment, valve 122 is adapted to be connected to fuel line outlet 143 via a connector 126. Fuel and/or cleaner from engine 154 are directed through fuel line outlet 243 into chamber 116 through valve 122.

The return of fuel and/or cleaner into chamber 116 via fuel line outlet 143 creates pressure in chamber 116, which facilitates the flow of the fuel and/or cleaner into and through conduit 120. In response to the pressure created in chamber 116 by the entering fuel and/or cleaner, the fuel and/or cleaner contained in chamber 116 is forced to flow through open end 121 into and through conduit 120, through which it is introduced into fuel line inlet 142 and engine 154, as discussed above. Thus, a continuous cycle of fuel and/or cleaner is created between engine 154 and cleaning tool assembly 110. The cycle is powered by the pumping action of transfer pump 156. Thus, cleaning tool assembly 110 is adapted to be powered mechanically by transfer pump 156, as opposed to electrically, such that no additional pump or power source is required. As a result, cleaning tool assembly 110 is considerably lower in cost and smaller in size and weight than previously used fuel injector cleaning devices.

Further, like cleaning tool assembly 10, cleaning tool assembly 110 is adapted to receive fuel from the fuel supply of the engine to which it is connected. For example, in the illustrated embodiment, transfer pump 156 supplies fuel from fuel tank 162 to engine 154. The mixture of excess fuel and/or cleaner from engine 154 is circulated or pumped through fuel return line 143 into chamber 116 of housing 112. As a result, cleaning tool assembly 110 does not require an additional or external fuel supply or tank to operate, which allows cleaning tool assembly 110 to be significantly smaller in size, weight and bulk than fuel injector cleaning apparatuses previously used.

As discussed above with respect to cleaning tool assembly 10, a valve 158, such as a gate valve, may be included to regulate the pressure in chamber 116. A monitor and/or gauge 150 may also be provided for displaying the pressure determined by gate valve 158. The pressure in chamber 116 may be adjusted such that the cleaner will be completely diluted after cycling between the engine and the cleaning tool assembly for approximately 20 minutes. Optionally, the pressure may be adjusted to between 5 and 25 psi. However, cleaning tool assembly 110 is adapted to withstand much higher pressures. Because use of the cleaning tool assembly may cause a drop in pressure in the fuel return line, a valve, such as a restrictor or restriction valve, may be provided as discussed above with respect to cleaning tool assembly 10.

Once the cleaner has become completely diluted in the fuel, such that only fuel is being supplied to engine 154, cleaning tool assembly 110 may be removed or disconnected from the engine system. However, cleaning tool assembly 110 may remain connected to the engine system for any desired amount of time, or until the fuel supply has run out. Optionally, cleaning tool assembly 110 may be adapted to be permanently connected to at least part of the fuel injection system of engine 154, or connected to another part or area of the vehicle or boat or the like, and refilled with cleaner as desired.

Cleaning tool assemblies 10 and 110 have a variety of uses. For example, the cleaning tool assemblies may be used with various engine types, including gasoline engines and diesel engines, which are particularly susceptible to clogged fuel injectors because of the small apertures in the injectors. Because of its small size and portable design, the cleaning tool assemblies may be used for various vehicles, boats, and other marine engines. Such vehicles may include trucks, cars and also fleet vehicles, such as construction vehicles and machines and the like.

Thus, the various embodiments of the cleaning tool assembly of the present invention provide a relatively low cost, mechanical device for cleaning the fuel injectors. The cleaning tool assembly provides cleaner to the fuel injectors of an engine and is adapted to provide either an immediate transition from cleaner to fuel or a gradual dilution of cleaner in the fuel to prevent damage to the engine. The cleaning tool assembly is adapted to function mechanically, using the transfer pump of an engine system as an energy source. Thus, the cleaning tool assembly does not require electrical components or separate or external pumps, resulting in a relatively inexpensive and lightweight device. In addition, the cleaning tool assembly is adapted to use fuel from an existing fuel supply, such as a fuel tank of a vehicle, as opposed to requiring a separate fuel supply or tank. Thus, the assembly is significantly smaller and lighter in weight than cleaning apparatuses previously used.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A cleaning tool assembly for a fuel injector of an engine having a fuel injection system including a fuel tank and a transfer pump, said tool assembly comprising:

a housing defining a chamber adapted to receive cleaner and fuel therein;

a conduit in fluid communication with said chamber and adapted to be in fluid communication with a fuel line connected to the engine;

wherein the transfer pump creates pressure in said chamber to force at least one of cleaner and fuel contained in said chamber into and through said conduit, wherein said conduit is adapted to supply the at least one of cleaner and fuel to the engine via said fuel line; and a piston positioned in said chamber for dividing said chamber into a cleaner portion adapted to receive cleaner and a fuel portion adapted to receive fuel.

2. The cleaning tool assembly of claim 1, wherein the transfer pump supplies fuel from the fuel tank to said fuel portion of said chamber to create pressure in said fuel portion, wherein said pressure causes said piston to travel in said chamber with respect to said conduit to expand said fuel portion and contract said cleaner portion.

3. The cleaning tool assembly of claim 2, wherein said conduit is in fluid communication with one of said cleaner portion and said fuel portion depending on the position of said piston in said housing.

4. The cleaning tool assembly of claim 1, including a fuel line outlet adapted to transfer at least one of fuel and cleaner from the engine to said chamber, wherein the at least one of fuel and cleaner creates pressure in said chamber.

5. The cleaning tool assembly of claim 4, wherein fuel supplied to said chamber dilutes the cleaner in said chamber.

6. The cleaning tool assembly of claim 5, wherein said conduit includes an opening positioned in said chamber, said conduit adapted to receive cleaner and fuel from said chamber through said opening.

7. A cleaning tool assembly for a fuel injector of an engine having a fuel injection system including a fuel tank, a transfer pump, said cleaning tool assembly comprising:

a housing defining an interior volume;

a piston positioned inside said housing for separating said interior volume into a cleaner portion adapted to receive cleaner and a fuel portion adapted to receive engine fuel from the transfer pump;

a tube operatively engaged with said piston, said tube having an opening in fluid communication with either said cleaner portion or said fuel portion as a function of a position of said piston, said tube adapted to be connected to a fuel line connected to the engine;

wherein the engine fuel supplied by the transfer pump creates pressure in the fuel chamber that causes said piston to travel along said tube to an opposite side of said opening in said tube, wherein the movement of said piston transitions said opening from receiving cleaner from said cleaner portion to receiving engine fuel from said fuel portion.

8. The cleaning tool assembly of claim 7, wherein movement of said piston contracts said cleaner portion of said cleaning tool assembly to force cleaner through said opening into said tube and into said fuel line.

9. The cleaning tool assembly of claim 7, wherein the pressure in said fuel portion of said cleaning tool assembly forces fuel through said opening into said tube and into said fuel line when said opening is in fluid communication with said fuel portion.

* * * * *